US006802538B2

(12) United States Patent
Laurash et al.

(10) Patent No.: US 6,802,538 B2
(45) **Date of Patent: *Oct. 12, 2004**

(54) GIFT CARD FORM AND METHOD OF FABRICATION

(75) Inventors: David F. Laurash, Bellbrook, OH (US); Jeffrey D. Kimble, Fairfield, OH (US); George T. Taylor, Bellevue, WA (US)

(73) Assignee: The Standard Register Company, Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/712,598

(22) Filed: Nov. 13, 2003

(65) Prior Publication Data

US 2004/0094948 A1 May 20, 2004

Related U.S. Application Data

(63) Continuation of application No. 09/841,675, filed on Apr. 24, 2001, now Pat. No. 6,682,099.

(60) Provisional application No. 60/222,455, filed on Aug. 2, 2000.

(51) Int. Cl.[7] ..... B42D 15/00

(52) U.S. Cl. ..... 283/61; 40/124.01; 40/124.191; 40/360; 40/630; 283/62; 283/81; 283/101; 283/106; 428/42.2

(58) Field of Search ..... 40/124.01, 124.09, 40/124.11, 360, 124.191, 630, 633, 665, 675; 283/61, 62, 81, 101, 105, 106, 117, 74, 75; 428/42.1, 42.2

(56) References Cited

U.S. PATENT DOCUMENTS

| | | | | |
|---|---|---|---|---|
| 4,062,138 | A | 12/1977 | Warenback | |
| 4,544,590 | A | 10/1985 | Egan | |
| 4,951,969 | A | 8/1990 | Epstein et al. | |
| 5,001,853 | A | 3/1991 | Odien | |
| 5,116,648 | A | 5/1992 | Martin et al. | |
| 5,131,686 | A | 7/1992 | Carlson | |
| 5,240,755 | A | 8/1993 | Zimmer | |
| 5,257,823 | A | 11/1993 | Colvin et al. | |
| 5,518,787 | A | 5/1996 | Konkol | |
| 5,662,976 | A | 9/1997 | Popat et al. | |
| 5,673,943 | A | 10/1997 | Campbell | |
| 5,803,505 | A | 9/1998 | Schwan et al. | |
| 5,825,996 | A | 10/1998 | Davis et al. | |
| 5,831,220 | A | 11/1998 | Ramsden et al. | |
| 5,890,743 | A | 4/1999 | Garrison et al. | |
| 5,915,733 | A | 6/1999 | Schnitzer et al. | |
| 6,517,921 | B2 | 2/2003 | Ulrich et al. | |
| 6,682,099 | B1 * | 1/2004 | Laurash et al. | 283/61 |
| 2002/0084649 | A1 | 7/2002 | Casagrande | |

* cited by examiner

*Primary Examiner*—Monica S. Carter
(74) *Attorney, Agent, or Firm*—Dinsmore & Shohl LLP

(57) ABSTRACT

Gift card forms and methods of making and using gift card forms are disclosed. The gift card form permits uniquely messaging each gift card. An appropriate gift card form can be printed at a time after manufacturing to allow a vendor to personalize the gift card. Additionally, order information, such as billing information, can be printed on the gift card form at the same time that the gift card is personalized. The gift card form can be kept as a record with the order information.

20 Claims, 5 Drawing Sheets

GIFT CARD FORM AND METHOD OF FABRICATION

CROSS REFERENCE TO RELATED APPLICATIONS

The present application is a continuation of U.S. patent application Ser. No. 09/841,675, filed Apr. 24, 2001 which claims the benefit of U.S. Provisional Patent Application No. 60/222,455, filed Aug. 2, 2000.

FIELD OF THE INVENTION

The present invention relates to gift cards and gift card forms and, more particularly, to such a gift card and gift card form and a method of fabricating and using a gift card and a gift card form.

BACKGROUND OF THE INVENTION

The emergence of the Internet, the popularity of mail order shopping, and e-commerce in general have created a need for personalized gift cards to be included with shipments to identify the senders of gifts to the recipients. Increasingly, people are gift shopping by using e-commerce including purchasing gifts using the Internet and purchasing gifts from catalogs. While this is convenient for the shopper, a problem encountered is that the recipient of a gift shipped directly from a retailer does not know who sent the gift unless there is something in the packaging identifying the gift sender. Current methods of identifying a donor include the use of letters or forms, written notes, written cards, notes on packing slips and loose inserts that are packed with the gift identifying the gift sender. However, these methods may fail to provide adequate identification, fail to bestow the decorativeness generally desired by gift senders, and fail to convey the intentions of the gift sender in sending the gift. The gift recipient may misidentify the gift sender using the current methods, or may fail to understand the reason for the gift. Not infrequently, a loose note or card may be entirely overlooked by the gift recipient.

Another prior art approach has been for the gift sender to mail a gift card separately to the gift recipient, notifying the recipient that a gift is coming. Such a separate card will likely not arrive at the same time the gift arrives, and this can be confusing for the recipient. Thus, there is a need for an improved decorative gift card which can accompany a gift sent directly from a retailer.

SUMMARY

This need is met by a gift card form which includes a face ply and a liner ply that is selectively adhered to the face ply. The face ply includes a gift card defined by a die cut. The face ply has an upper surface and a lower surface. The liner ply is selectively adhered to the lower surface of the face ply and is removably adhered to the lower surface of the gift card.

A method of fabricating and using a gift card is disclosed. A gift card form as described above is provided. An upper surface of the face ply is imaged with a second message. The gift card is removed from the gift card form. The gift card is attached to a package.

The present invention provides for a gift card and gift card form that permit uniquely messaging each gift card. A gift card form can be printed at a time after manufacturing to allow a vendor to personalize the gift card. Additionally, order information, such as billing information, can be printed on the gift card form when the gift card is personalized. The gift card form can be kept as a record with the order information after the gift card is removed from the form and applied to the package.

DETAILED DESCRIPTION

Figure 1A:
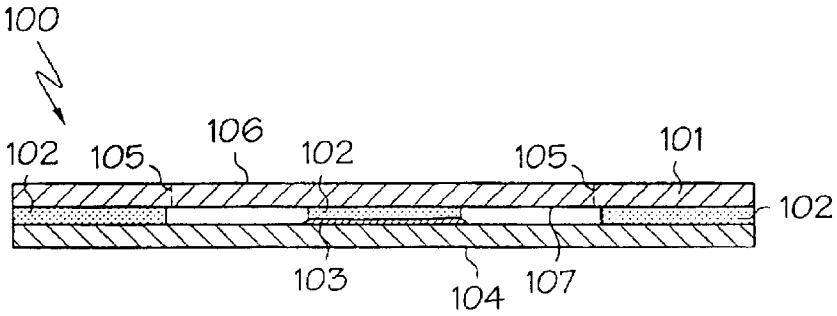
FIG. 1A illustrates a cross section of a gift card form according to one embodiment of the invention, taken along line 1A—1A in FIG. 1B.
Figure 1B:
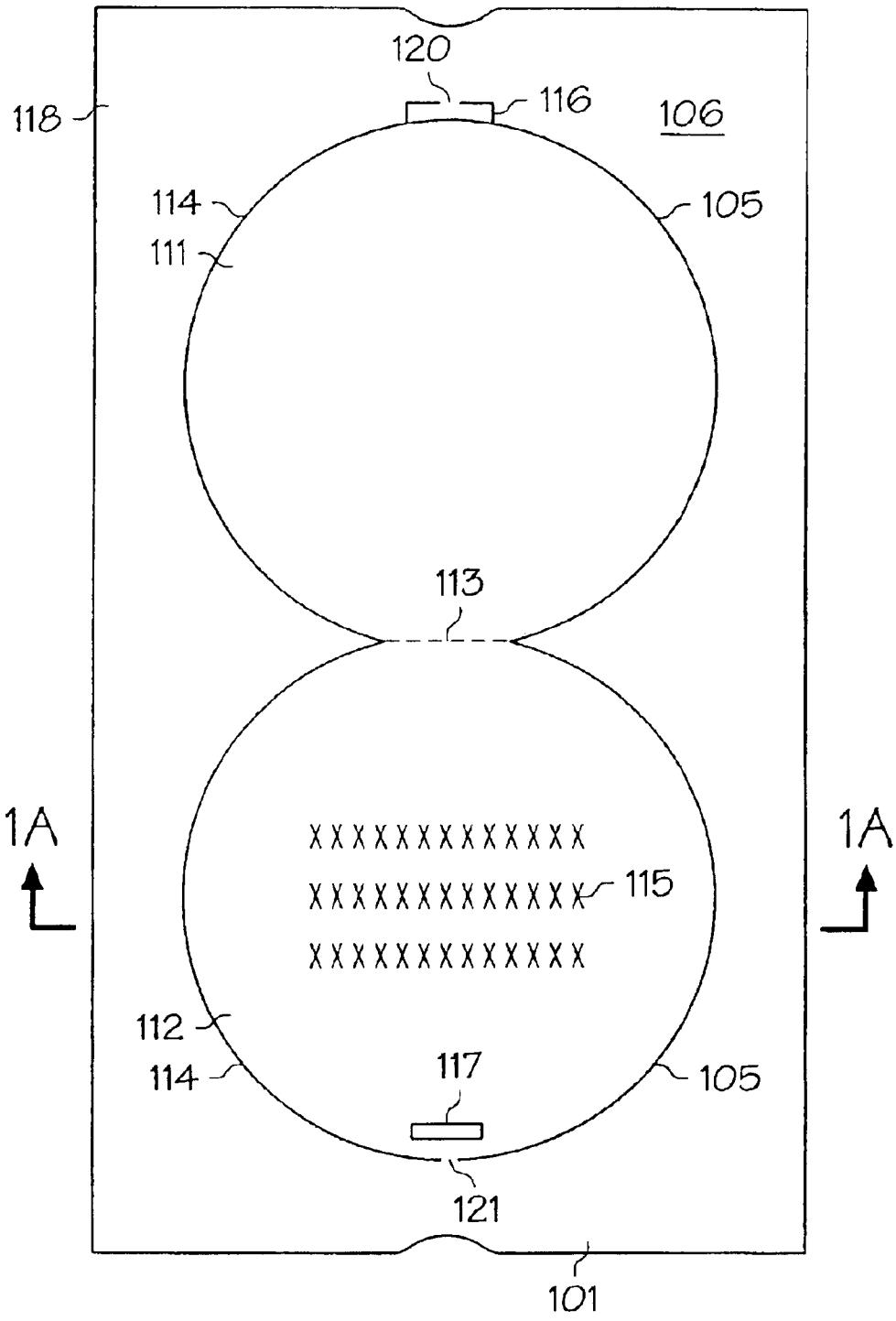
FIG. 1B illustrates a plan view of the gift card form of FIG. 1A.
Figure 1C:
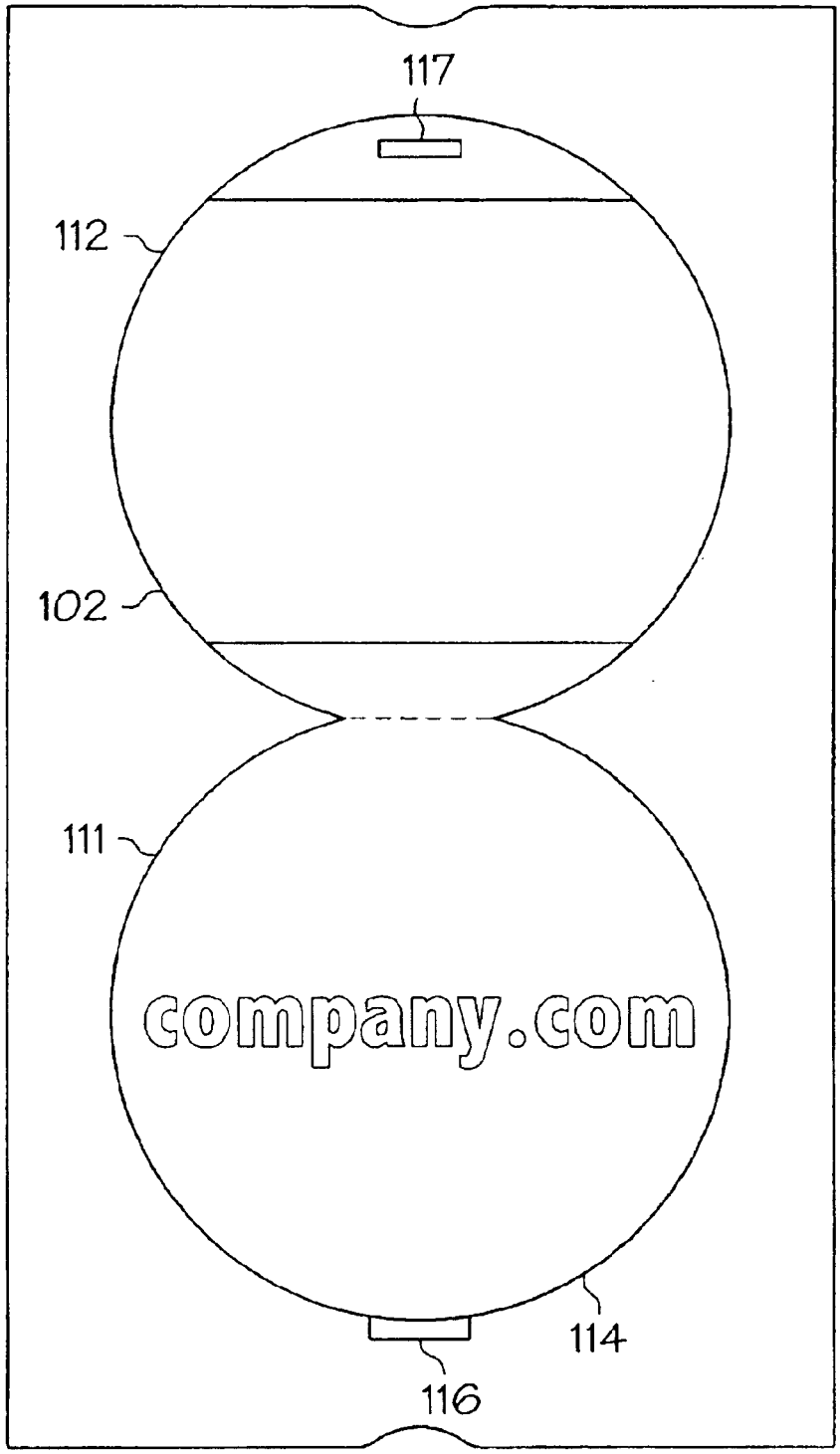
FIG. 1C illustrates a plan view of the gift card after removal from the form shown in FIGS. 1A and 1B.

FIGS. 1A and 1B illustrate a gift card form according to one embodiment of the invention, and FIG. 1C is a plan view of the gift card 114 after removal from the form. FIG. 1A is a cross section of the gift card form, and FIG. 1B is a plan view of the gift card form. The gift card form 100 is a two ply construction, and comprises a face ply 101 having a die cut 105, an adhesive 102, silicon coating 103, and liner ply 104. The face ply or upper ply 101 may be comprised of a heavy weight decorative paper or file card stock. However, other printable or imageable materials may be used. In this embodiment, the thickness of the face ply 101 is preferably 7–10 pt; however, it will be appreciated that other embodiments of the invention may have a thickness of a face ply that is not in this range. Optionally, the liner ply 104 ply may also be comprised of a printable material. The liner ply 104 may be made of regular paper, heavy weight paper, card stock, or a polymer film such as polyester, polypropylene or polystyrene, or the like. The liner ply 104 may have substantially the same dimensions as the face ply 101, and may preferably have a thickness of 2.5–5 mil, which is typical for conventional liners. It will be appreciated, however, that the invention may also utilize a liner having a thickness outside of this range. The face ply 101 has an upper surface 106 and a lower surface 107. The lower surface 107 is laminated toward the liner ply 104 and the upper surface 106 is positioned facing away from the liner ply 104. The upper surface 106 and the lower surface 107 of the face ply 101 may be printed or imaged with conventional press inks. Either the upper surface 106 or the lower surface 107 of the face ply 101 may be decorated with a foil material, and transparent inks can be printed over the foil to change its color, if desired.

A die cut 105 in face ply 101 defines a gift card 114. The gift card 114 has an upper portion 111 and a lower portion 112 with a fold line 113 separating the upper portion 111 and the lower portion 112. A pattern of adhesive 102 is applied between the plies 101 and 104 to hold the face ply 101 and the lower portion 112 of the card to the liner ply 104. The liner ply 104 includes a spot of silicon release coating 103 on an area of the surface of the liner ply 104 which contacts with the adhesive applied to the lower portion 112 of the card. The adhesive 102 holds the gift card 114 to the liner ply 104 during processing. Further, the adhesive 102 attaches the card to a package after the gift card 114 has been processed and removed from the liner ply 104 and the balance of the face ply 101. The spot of silicon release coating 103 permits the card to be removed from the lower ply 104 easily when the card is to be applied to a gift package.

The gift card 114 can have any shape desired. A variety of designs and shapes of cards may be used with this embodiment. For example, a red heart shape, a green Christmas tree or wreath, a birthday cake or the like may be used for the card. The gift card 114 may be embellished with embossing or with hot foil stamping on any surface. Further, transparent ink may be printed over foil to alter the color of the card.

One or more ties 120, bridging the die cut 105, hold the upper portion 111 to the balance of the face ply 101. A score line or lines of perforation defines the fold line 113 which facilitates folding the card accurately. The adhesive 102 is preferably pressure sensitive adhesive and may be permanent adhesive, removable adhesive or repositionable adhesive, depending on the end use or application. Additionally, a slit 117 can be cut into the lower portion 112. One or more ties 121, bridging the die cut 105, hold the lower portion 112 to the balance of the face ply 101. When the card is folded over, a tab 116 can be inserted into slit 117 to help the card remain flat on a package during wrapping, packaging and shipping operations. The upper surface of the lower portion 112 is, generally, where a sender or donor message 115 is printed during processing. The message 115 can include a greeting, a recipient name, a donor name or the like. The gift card form 100 may be variably imaged by impact or non-impact printers. Exemplary non impact printer types include laser, inkjet, thermal, thermal transfer and ion deposition. The preferred print method is thermal transfer.

Figure 2A:
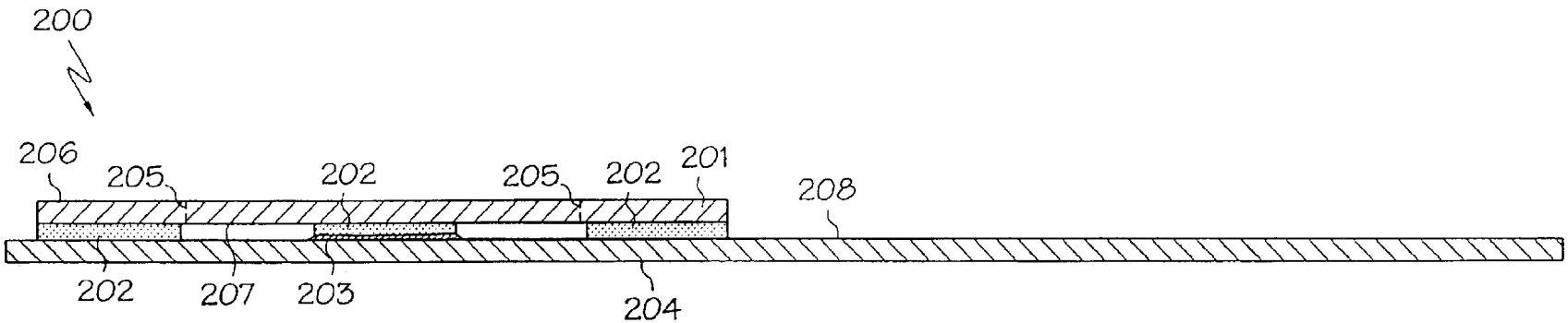
FIG. 2A illustrates a cross section of a gift card form according to another embodiment of the invention, taken along line 2A—2A in FIG. 2B.
Figure 2B:
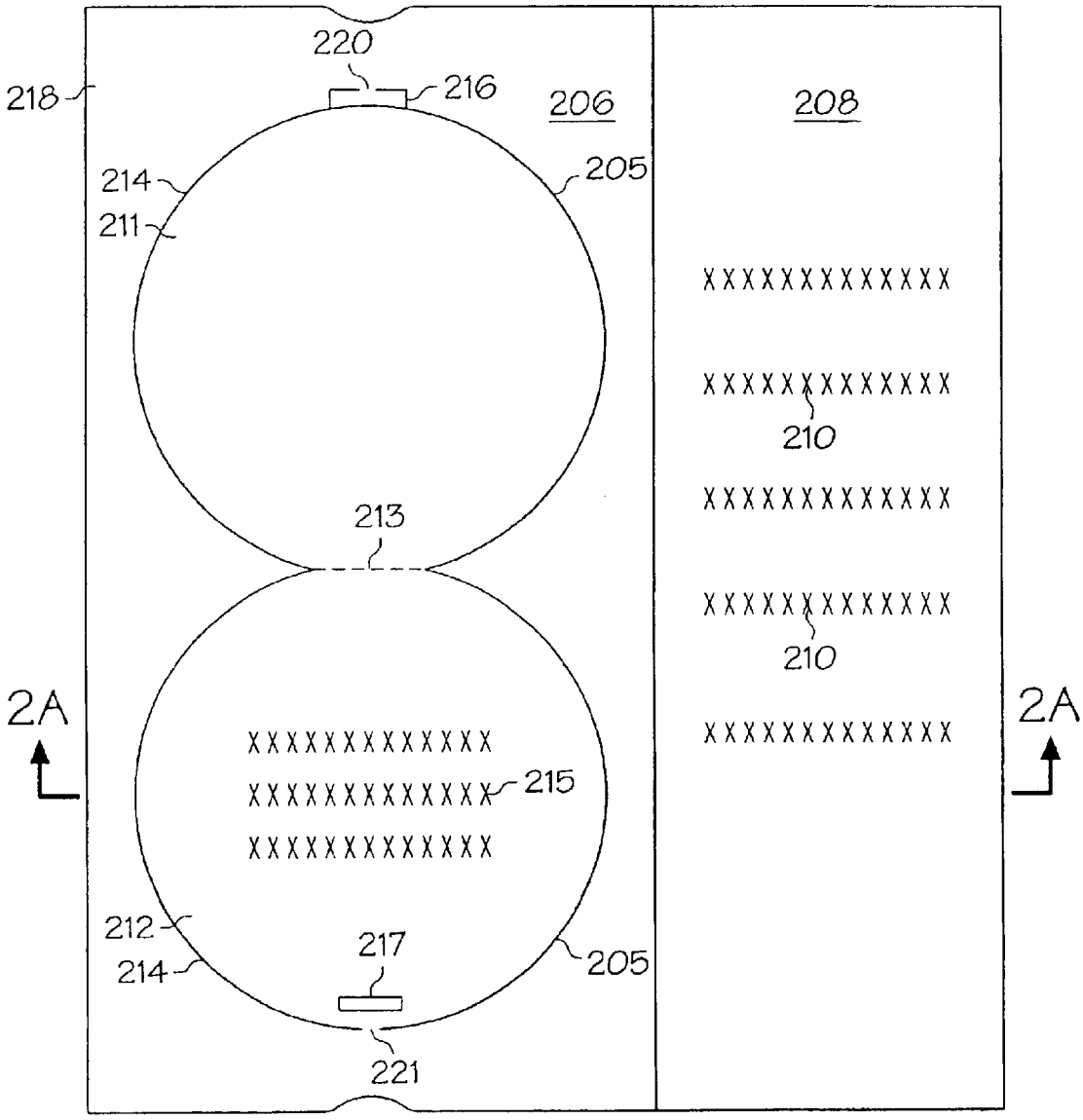
FIG. 2B illustrates a plan view of the gift card form of FIG. 2A.

FIGS. 2A and 2B illustrate a gift card form constructed according to another embodiment of the invention. FIG. 2A is a cross sectional view of the gift card form taken along line 2A—2A in FIG. 2B, a plan view of the gift card form. The gift card form is a two ply construction. The gift card form comprises a face ply 201, an adhesive 202, silicon release coating 203, liner ply 204, a die cut 205 defining gift card 214 and an order information region 210. The face ply or upper ply 201 is comprised of a heavy weight, decorative paper or file card stock. In this embodiment, the thickness of the face ply 201 is preferably 7–10 pt; however, it will be appreciated that the face ply in other versions of this embodiment of the invention may have a thickness not in this range. The liner ply 204 can also be comprised of a heavy weight paper or card stock. Alternatively, the liner ply 204 may be comprised of any other printable material. The liner ply 204 preferably has a thickness of 2.5–5 mils which is the thickness of typical conventional liners. It will be appreciated, however, that the invention may utilize a liner ply having a thickness outside of this range. The liner ply 204 has an upper surface 208 which is positioned facing towards the face ply 201.

The liner ply 204 may have a width greater than the width of the face ply 201 to allow for printing on the order information region 210. The order information area 210 is portion of the upper surface 208 of the liner ply 204 that is not covered by the face ply 201. The order information area 210 can be printed or imaged during order processing, with billing information, donor or sender address and the like. After the gift card form is processed and the gift card 214 removed, the information in region 210 provides a record of the order.

The face ply 201 has an upper surface 206 and a preferably decorative, lower surface 207. The lower surface 207 is laminated toward the liner ply 204 and the upper surface is positioned facing away from the liner ply 204. The upper surface 206 and the lower surface 207 of the face ply 201 may be printed or imaged with conventional press inks. If the lower surface 207 of the face ply 201 has a foil layer, transparent inks can be printed over the foil to change it to various metallic colors.

The face ply 201 includes a gift card 214 having an upper portion 211 and a lower portion 212. The gift card 214 may be embellished with embossing or with hot foil stamping on its lower surface, as shown in FIG. 1C. A pattern of adhesive 202 may be applied between the plies 201 and 204 to hold the face ply 201 and the lower portion 212 of the card to the liner ply 204. The liner ply 204 includes a coating of silicon release material 203 on a portion of the surface of the liner ply 204. The coating of silicon release material contacts the adhesive on the lower portion 212 of the card. The adhesive 202 holds the gift card 214 to the liner ply 204 during processing including printing, and then is used to attach the card to a package after the gift card 214 has been processed and removed from the face ply 201 and liner ply 204. The coating of silicon release material 203 permits the card to be removed from the lower ply 204.

The gift card 214 can have any overall shape desired, and a variety of designs and shapes of cards may be used with this embodiment. A die cut 205 defines the shape of the card 214 on the face ply 201. One or more ties 220 hold the upper portion 211 to the rest of the face ply 201. A score line or perforation line 213 may define a fold line, permitting the card to be folded over easily. The adhesive 202 is preferably pressure sensitive and it may be permanent adhesive, removable adhesive or repositionable adhesive depending on the end use or application. One or more ties 221 hold the lower portion 212 to the rest of the face ply 201. Additionally, a slit 217 can be cut into the lower portion 212, and a tab 216 provided in the upper portion 211. The tab 216 can be inserted in slit 217 when the card is folded over, helping the card remain flat on a package during wrapping, packaging and shipping operations. The upper surface of the lower portion 212 is, generally, where a sender or donor message 215 is printed during processing. The message 215 may include a greeting, recipient name, donor name or the like.

Figure 3:
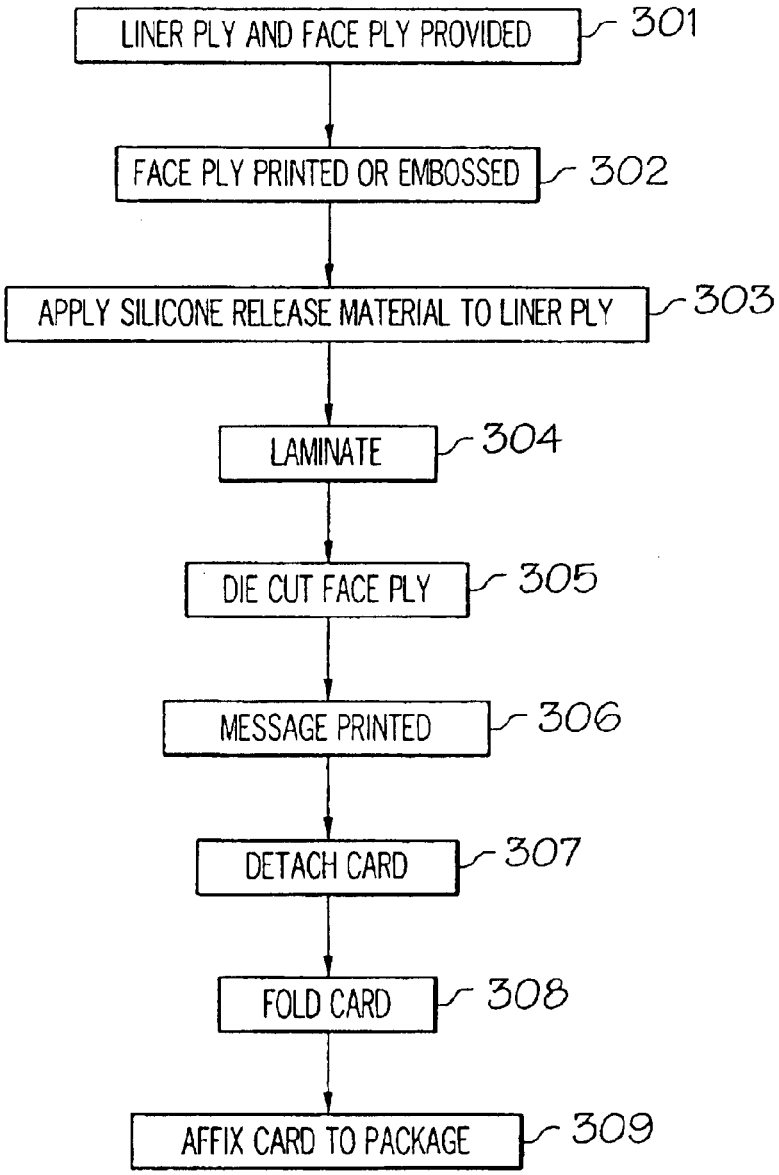
FIG. 3 illustrates a method of fabricating and using a gift tag according to one embodiment of the invention.

FIG. 3 illustrates the method of fabricating and using a gift card form according to one embodiment of the present invention. A liner ply and a face ply are provided at block 301. The face ply is imaged or embossed with a greeting or name on an upper surface, on a lower surface or on both prior to laminating the face ply and the liner ply at 302. A spot of silicone release material is applied to an upper surface of the liner ply to permit an adhesive to adhere releasably to at least a portion of the upper surface of the liner ply at 304. A lower or decorative surface of the face ply is at least partially laminated to the upper surface of the liner ply at 305 such that the card may be subsequently removed. The face ply is die cut to define the gift card at 303. If desired, the face ply may be die cut according to a desired geometric shape of the card after lamination of the face ply and liner ply at 305. The die cut area of the face ply comprises the perimeter or boundaries of the card. The spot of silicon permits a lower portion of the card to adhere releasably to the liner ply. A personalized message or greeting can be imaged or printed at 306 on the upper surface of the face ply. The message can be provided by the gift sender when the gift order is taken. The card is then detached at 307. The card is folded over at 308 and attached to a package at 309. The package may then be shipped to a recipient, and the recipient can easily identify the gift sender and gift sender intentions by reading the gift card. Since the card is adhesively attached to the gift, the likelihood of it becoming lost, overlooked or separated from the gift is significantly reduced.

Having described the present invention in detail and by reference to various embodiments thereof, it will be apparent that modifications and variations are possible without departing from the scope of the invention.

What is claimed is:

1. A gift card form, comprising:

a face ply comprising a gift card defined in said face ply wherein:

said face ply comprises an upper surface and a lower surface;

said gift card comprises an upper surface and a lower surface;

said gift card comprises an upper portion and a lower portion;

said upper portion is separated from said lower portion by a fold line;

said lower surface of said gift card has an adhesive disposed thereon; and said lower surface of said upper portion of said gift card is substantially adhesive free; and a liner ply adhered to at least a portion of the lower surface of said face ply.

2. The gift card form as claimed in claim 1 wherein said gift card is defined by a die cut in said face ply.

3. The gift card form as claimed in claim 1 wherein said liner ply is removably adhered to at least a portion of said lower surface of said gift card.

4. The gift card form as claimed in claim 1 wherein said upper portion of said gift card and said lower portion of said gift card are each generally circular in shape, and wherein said gift card is generally circular in shape when said gift card is folded along said fold line.

5. The gift card form as claimed in claim 1 wherein said upper portion of said gift card and said lower portion of said gift card are each generally rectangular in shape, and wherein said gift card is generally rectangular in shape when said gift card is folded along said fold line.

6. The gift card form as claimed in claim 1 wherein said form further includes one or more ties between said gift card and the balance of said face ply.

7. The gift card form as claimed in claim 6 wherein said upper portion of said gift card includes a tab and said lower portion of said gift card includes a slit corresponding in size to said tab.

8. The gift card form as claimed in claim 1 wherein said lower surface of said gift card is printed with a greeting and said upper surface of said gift card is imageable.

9. The gift card form as claimed in claim 1 further comprising a layer of foil material on said lower surface of said face ply.

10. The gift card form as claimed in claim 1 wherein said lower surface of said gift card is embellished with embossing.

11. The gift card form as claimed in claim 1 wherein said adhesive on said lower surface of said gift card comprises a repositionable adhesive.

12. The gift card form as claimed in claim 1 wherein:

said face ply has a first width;

said liner ply has a second width;

said second width is greater than said first width;

said liner ply includes an order information area;

said liner ply has an upper surface and a lower surface; and at least a portion of said upper surface of said liner ply is adhered to at least a portion of said lower surface of said face ply.

13. The gift card form as claimed in claim 12 wherein said liner ply comprises card stock.

14. The gift card form of claim 12, wherein said liner ply and said face ply are printable on a non-impact printer.

15. The gift card form of claim 1 wherein said adhesive on said lower surface of said gift card comprises permanent adhesive.

16. The gift card form of claim 1 wherein said adhesive comprises pressure sensitive adhesive.

17. A method, comprising:

providing a gift card form wherein said gift card form comprises:

a face ply comprising a gift card defined in said face ply wherein:

said face ply comprises an upper surface and a lower surface;

said gift card comprises an upper surface and a lower surface;

said gift card comprises an upper portion and a lower portion;

said upper portion is separated from said lower portion by a fold line;

said lower surface of said gift card has an adhesive disposed thereon; and said lower surface of said upper portion of said gift card is substantially adhesive free;

a liner ply adhered to at least a portion of the lower surface of said face ply; and a first message on said lower surface of said upper portion of said gift card;

imaging said upper surface of said gift card with a second message;

removing said gift card from said gift card form; and attaching said gift card to a package.

18. The method as claimed in claim 17 wherein the step of imaging said upper surface of said gift card with a second message comprises printing said second message utilizing thermal transfer printing.

19. The method as claimed in claim 17 wherein said liner ply includes an order information area.

20. The method as claimed in claim 19 further comprising printing order information on said order information area.

* * * * *